US005703305A

United States Patent [19]

Isaka

[11] Patent Number: 5,703,305

[45] Date of Patent: Dec. 30, 1997

[54] MUSIC BOX

[75] Inventor: Akihiko Isaka, Nagano, Japan

[73] Assignee: Sankyo Seiki Mfg. Co., Ltd., Nagano, Japan

[21] Appl. No.: 615,524

[22] Filed: Mar. 11, 1996

[30] Foreign Application Priority Data

Mar. 13, 1995 [JP] Japan ..... 7-052313

[51] Int. Cl.[6] ..... G10F 1/06

[52] U.S. Cl. ..... 84/95.1

[58] Field of Search ..... 84/95.1, 95.2, 84/94.1, 94.2

[56] References Cited

U.S. PATENT DOCUMENTS 4,458,573 7/1984 Isaka ..... 84/95.1

5,449,856 9/1995 Nakamori ..... 84/95.1

FOREIGN PATENT DOCUMENTS 62-43366 11/1987 Japan .

*Primary Examiner*—Cassandra C. Spyrou

*Attorney, Agent, or Firm*—McAulay Fisher Nissen Goldberg & Kiel, LLP

[57] ABSTRACT

A music box comprises a drive shaft for winding a spring, a drum which rotates with transmitted rotation of the drive shaft when a spring is released, a vibrating plate with reeds for playing music when struck by pins on the drum, speed governing device having a speed increasing gear train which transmits the rotation of the drive shaft and a worm shaft which is positioned in the final step of the speed increasing gear train and on which a rotor is fixed, a frame for rotatably supporting the drive shaft and one end of the worm shaft and on which the drum, the vibrating plate and the speed governing device are arranged and a housing unit which rotatably supports the drive shaft and has a spring enclosure for enclosing a spring and a support unit which is formed at an end of the spring enclosure and supports the other end of the worm shaft. The support unit comprises a bearing unit which rotatably supports the other end of the worm shaft at a center thereof, an outer frame formed to enclose the bearing unit and a slit being formed between the bearing unit and the outer frame.

15 Claims, 5 Drawing Sheets

MUSIC BOX

TECHNICAL FIELD

This invention relates to a music box with an improved structure of a speed governor which supports a worm shaft, at a support unit, that is integrally formed with a spring enclosure or "spring housing".

DESCRIPTION OF THE RELATED ART

The applicant herein proposed a speed governor in U.S. Pat. No. 4,458,573, in which governing action using the air resistance of the rotor on a worm shaft is normally obtained when the worm shaft runs at a low speed, and additionally, at a high speed, the rotor being spread axially and radially of the worm shaft, a reliable brake power is generated by the contact resistance between the rotor and the brake unit. Currently many music boxes primarily use this speed governor.

In the music box disclosed in the above patent, this speed governor is comprised of a support unit that projects to the side of the upper end of the enclosure to hold a spring and has a brake unit underneath, a rotor, and a worm shaft which rotates integrally with the rotor; the upper end of the worm shaft is supported by means of a bearing unit of the support unit and the lower end of the worm shaft is supported by means of a bearing unit of a frame.

Extremely excessive weight may be loaded on the support unit which projects from the aforesaid spring enclosure when the music box is dropped, pulled or collides with other objects while being carried/transported or assembled with dolls, jewels, toys and the like. This music box has certain drawbacks: when excessive weight is loaded on the support unit, the support unit is bent and the tip of the worm shaft may scratch a bearing unit in the support unit; as a result, the music box may have trouble in starting to play; or the worm shaft may be spread and the music box is made dysfunctional. A special problem arises when an excessive up-down force is experienced on the aforesaid support unit, whereupon many music boxes will experience a significant driving problem.

In order to avoid the above mentioned drawbacks, another approach arranges a pillar between the end of the support unit opposite the enclosure and the frame. However, in this approach, spaces for placing the music box stopper are limited. That is, the stopper insertion direction is limited, which affects the music box installation position on a product.

OBJECT AND SUMMARY OF THE INVENTION

The primary object of this invention is to provide a music box with counter measures for the aforesaid drawbacks so that when an excessive load is applied to the support unit having a bearing unit which supports the worm shaft ends, the tip of the worm shaft does not scratch the bearing and the worm shaft can be kept from being spread.

In accordance with the present invention, a music box comprises a drive shaft for winding a spring, a drum which rotates with transmitted rotation of the drive shaft when a spring is released, a vibrating plate with reeds for playing music when struck by pins on the drum, speed governing means having a speed increasing gear train which transmits the rotation of the drive shaft and a worm shaft which is positioned in the final step of the speed increasing gear train and on which a rotor is fixed, a frame for rotatably supporting the drive shaft and one end of the worm shaft and on which the drum, the vibrating plate and the speed governing means are arranged and a housing unit which rotatably supports the drive shaft and has a spring enclosure for enclosing a spring and a support unit which is formed at an end of the spring enclosure and supports the other end of the worm shaft. The support unit comprises a bearing unit which rotatably supports the other end of the worm shaft at a center thereof, an outer frame formed to enclose the bearing unit and a slit being formed between the bearing unit and the outer frame.

DETAILED DESCRIPTION OF THE PREFERRED EMBODIMENT

Figure 1:
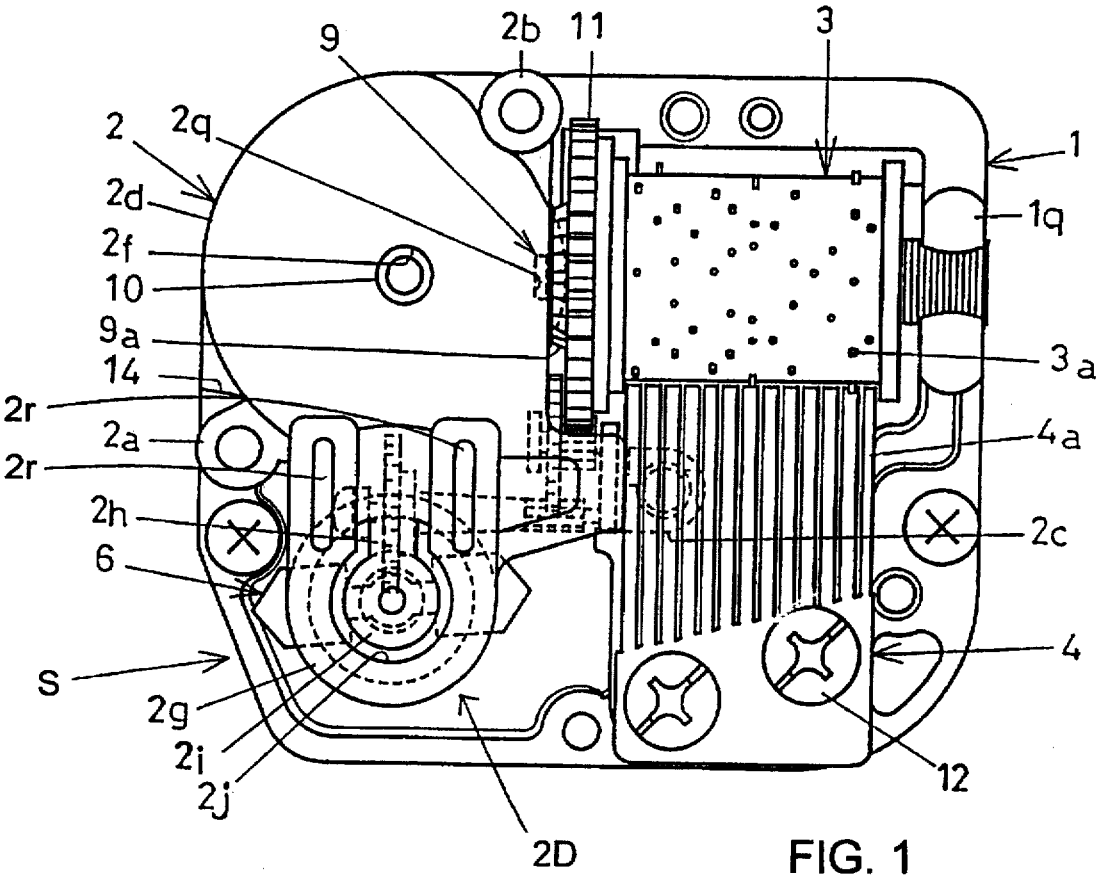
FIG. 1 illustrates the top view of a music box.

In a music box illustrated in FIGS. 1–4, a housing unit 2 comprised of a spring enclosure which holds a spring and support unit 2D covers a corner of frame 1; a speed governor S is formed between the support unit 2D and frame 1. In addition, a drum 3 is supported by the spring enclosure **2*d* and a pier 1*q* on frame 1; the drum 3 fronts a vibrating plate 4 fixed on a seat 1*r***.

The housing unit 2 is integrally formed of synthetic resin, as illustrated in detail in FIGS. 5–9. In FIGS. 1–9, the housing unit 2 comprises fitting members **2*a*, 2*b*, 2*c*, by means of which the housing unit 2 is attached to frame 1, a cylindrical spring enclosure 2*d* for enclosing a spring, a spring engagement opening 2*e* formed on a partial outer circumferential wall of the spring enclosure 2*d* and engaged with one end of the spring, a hole 2*f* formed on the upper end of the spring enclosure 2*d* for supporting a drive shaft 10, a support unit 2D projected on the upper end of the spring enclosure 2*d* toward the side of the aforesaid speed governor S orthogonal to the shaft direction of the drive shaft 10** to support the speed governor S.

Figure 2:
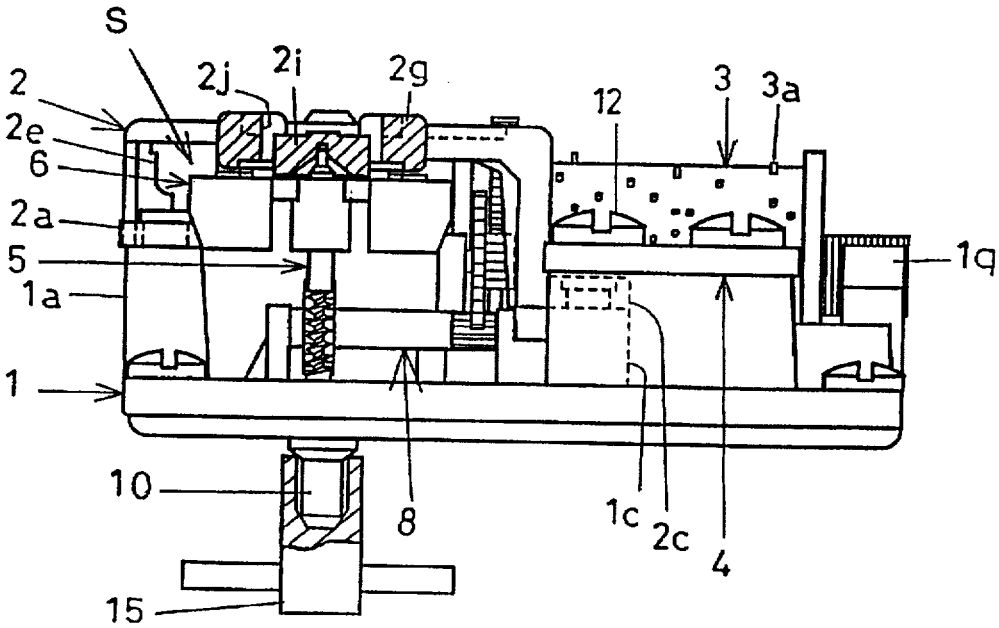
FIG. 2 illustrates the side view of major components of a music box.
Figure 3:
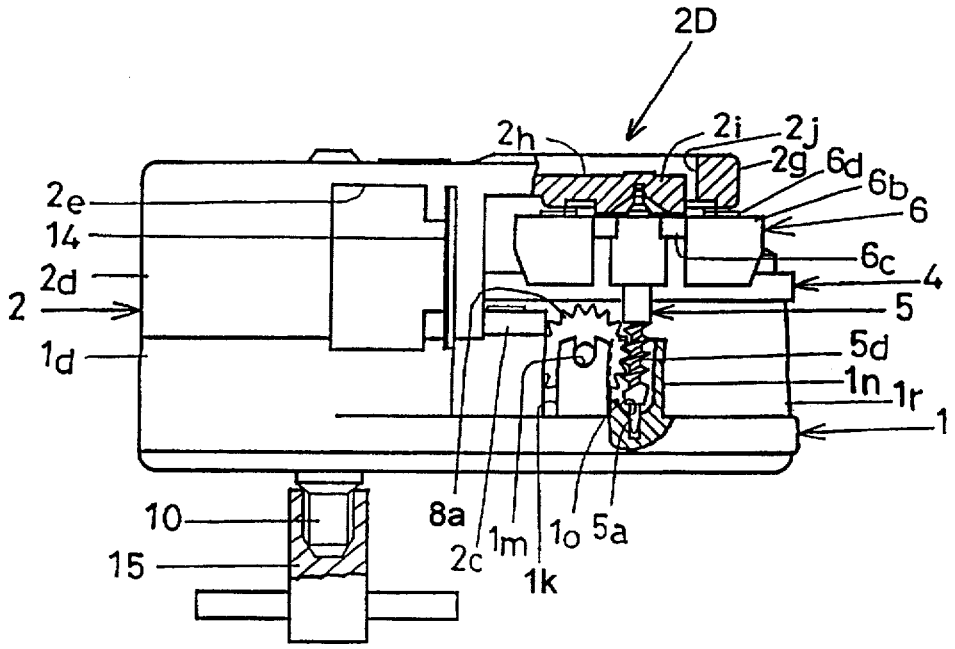
FIG. 3 illustrates the other side view of major components of a music box.
Figure 5:
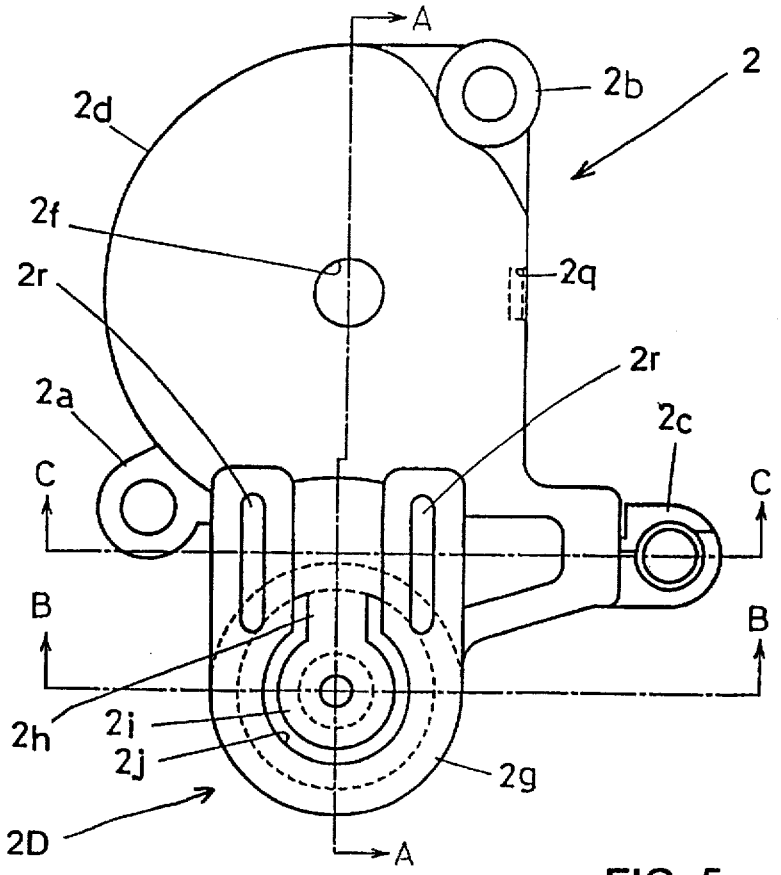
FIG. 5 illustrates the top view of a housing unit.
Figure 4:
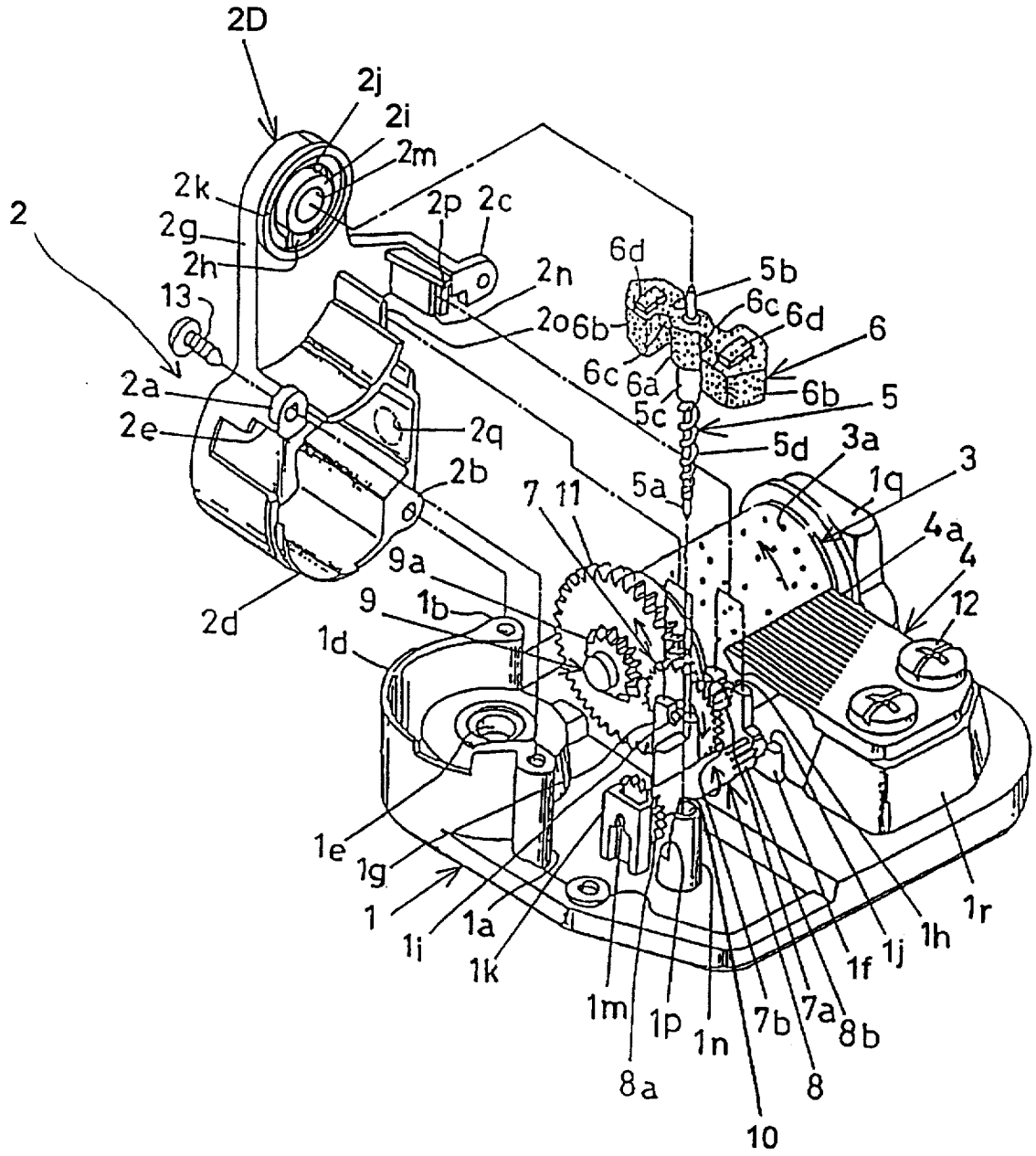
FIG. 4 illustrates the disassembled perspective view of a music box.
Figure 6:
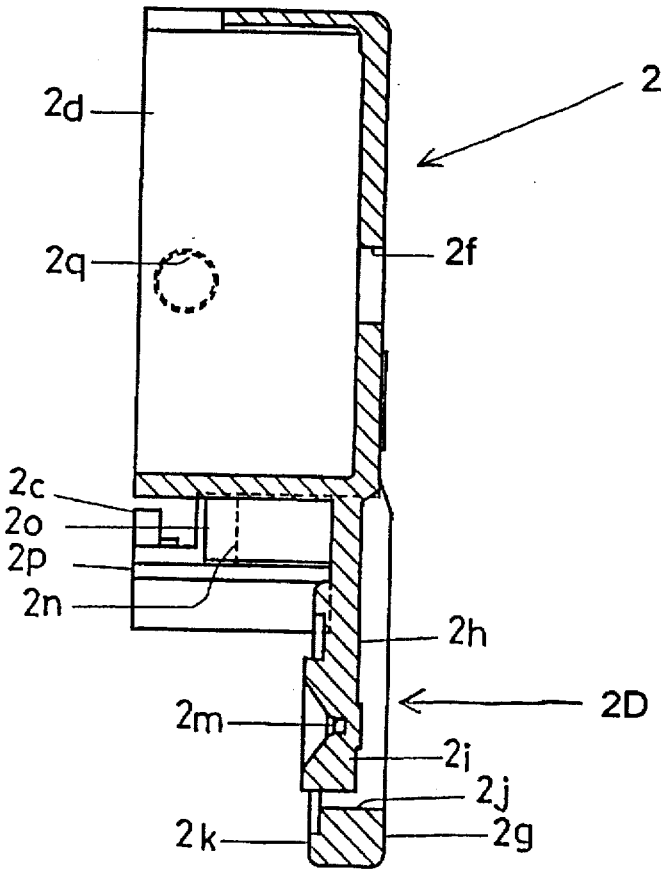
FIG. 6 illustrates the A—A cross section of FIG. 5.
Figure 7:
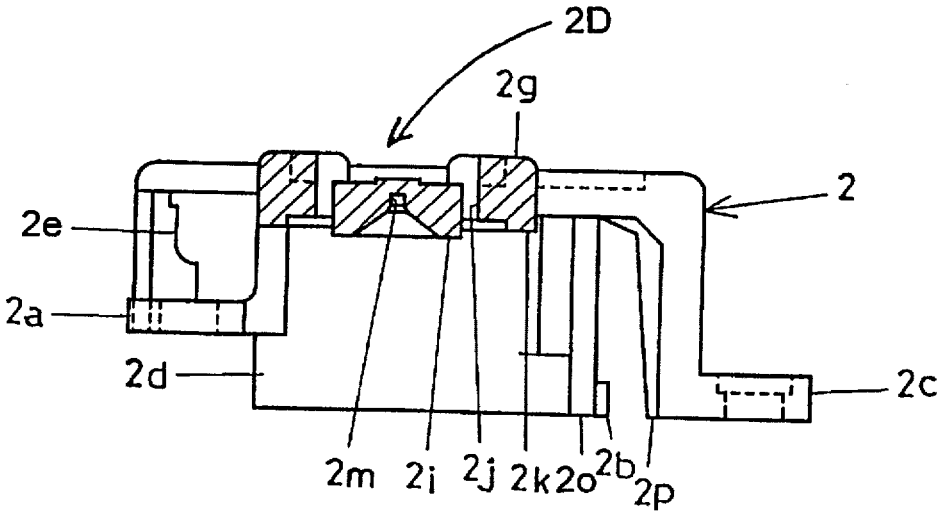
FIG. 7 illustrates the B—B cross section of FIG. 5.
Figure 8:
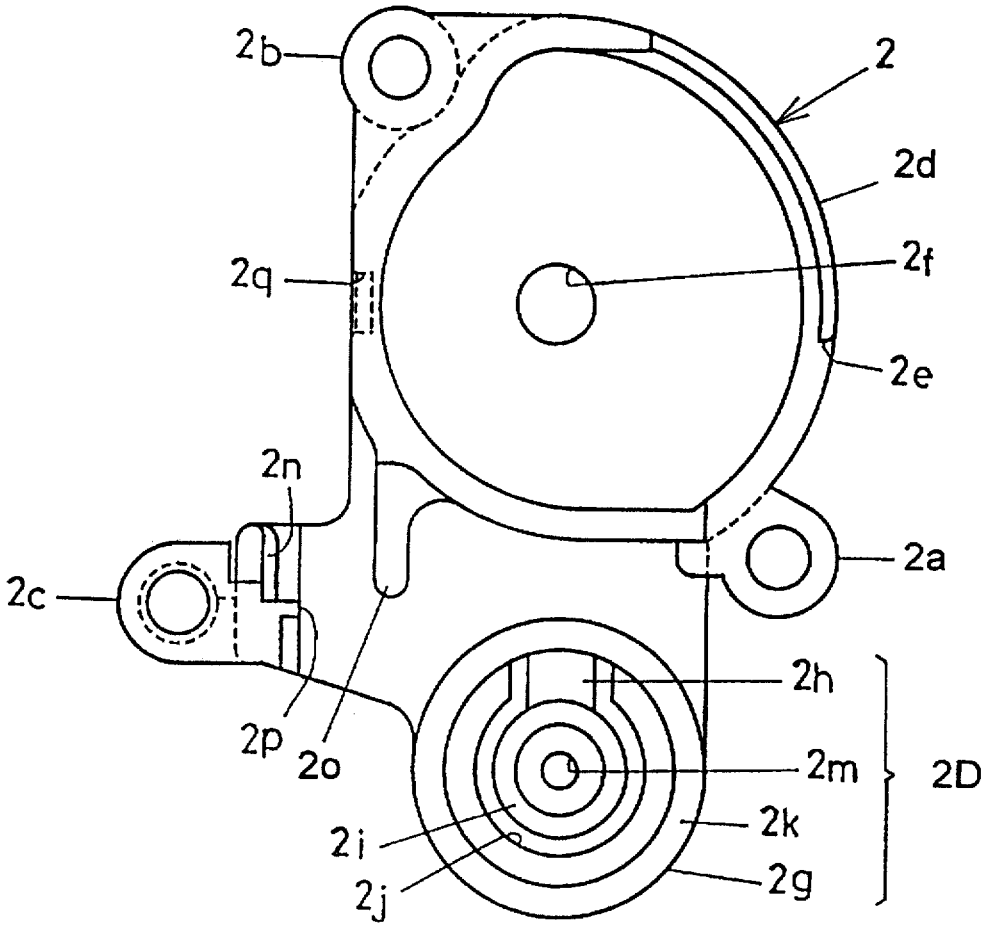
FIG. 8 illustrates the bottom view of a housing unit.
Figure 9:
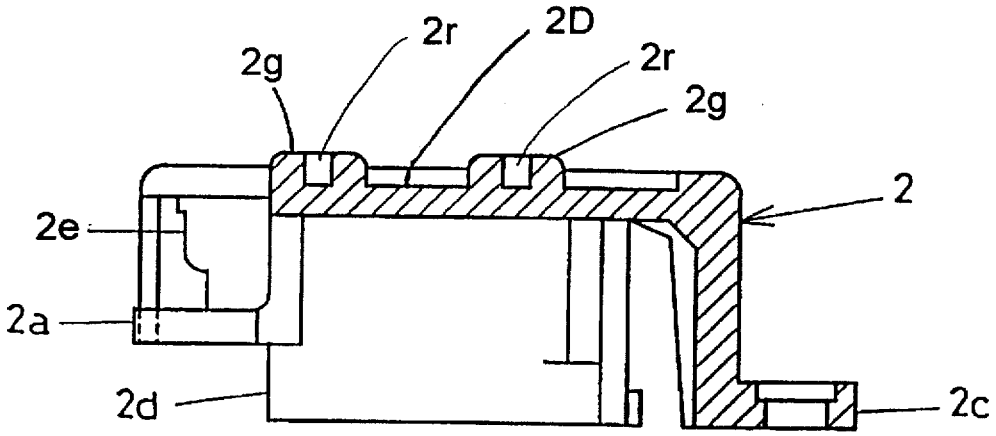
FIG. 9 illustrates the C—C cross section of FIG. 5.

There are formed, at the support unit 2D, a bearing unit **2*i* connected to an elastic arm 2*h*, a slit 2*j* which surrounds both sides of the arm 2*h* and most of the circumference of the bearing unit 2*i*, and the outer frame 2*g* along the outer circle of the support unit 2D. The outer frame 2*g* is formed, as illustrated in FIGS. 2–3, to be higher than the bearing unit 2*i* and the arm 2*h* in the shaft direction of the worm shaft 5 and is also thickly formed. In addition, on the upper end of the spring enclosure 2*d* side of the outer frame 2*g* are formed two grooves 2*r* for providing a concavity to prevent loosening or deforming. Furthermore, under the edge of the outer frame 2*g* and along its edge is formed a ring-shaped brake unit 2*k* around the center of the worm shaft 5; in other words, the brake unit 2*k* is formed concentric to the bearing unit 2*i* and is ring-shaped. Moreover, on the bottom of the bearing unit 2*i* a shaft hole 2*m*** is formed.

Between the fitting member 2c and the spring enclosure 2d are formed shaft retainers 2n, 2o, 2p. On the outside wall of the drum 3 side of the spring enclosure 2d is formed a shaft hole 2q for supporting the drum 3.

The aforesaid speed governor S comprises the worm shaft 5, a rotor 6 fixed on the worm shaft 5, the bearing unit 2i connected to the elastic arm 2h, a brake unit 2k, a middle gear 7 and a worm gear 8 of speed increasing gear train which accelerates and transmits the rotation of the aforesaid drive shaft 10.

The rotor 6, in this embodiment, is formed of an elastic material such as rubber and its boss unit 6a is press fitted to the shaft unit 5c.

The drum 3 has a drum shaft 9 and pins 3a are formed on outer surface or circle of the drum 3. The drum shaft 9 is formed integral with a bevel gear 9a and a flat gear 11. One end of the drum shaft 9 is supported by the shaft hole 2q of the spring housing unit; the other end of the drum shaft 9 is supported by the projection 1q of frame 1.

The bevel gear 9a is engaged with a gear, not shown, in the spring enclosure 2d attached to the drive shaft 10 which winds a spring. The above mentioned gear in the spring enclosure 2d is installed on the drive shaft 10 via a one-way clutch mechanism. Therefore, the aforesaid gear does not rotate during winding; it rotates only when the spring is released. The flat gear 11 is engaged with a pinion 7a of the middle gear 7 of the speed increasing gear train.

The pinion 7a and a gear 7b are formed on the middle gear 7. The worm gear 8a and the pinion 8b are formed on the worm shaft 8 and the pinion 8b is engaged with the gear 7b. The vibrating plate 4 is fixed on a seat 1r using screws 12; a plurality of vibrating reeds 4a are formed on the vibrating plate 4; the vibrating reeds 4a are arranged so that pins 3a play them.

The music box is configured in such a way that the fitting members 1a, 1b, 1c of frame 1 and the cylinder unit 1d and the fitting members 2a, 2b, 2c of the housing unit 2 and the spring enclosure unit 2d for retaining a spring are respectively overlapped and fixed by means of caulking or screws.

One end 14 of a spring is engaged with a spring engagement opening 2e formed on the side wall of the spring enclosure 2d of the housing unit 2; the other end of the spring is engaged with a hole 2f formed on the upper surface of the spring enclosure 2d and with a drive shaft 10 for winding a spring held in a hole 1e at the bottom of the cylinder unit 1d of frame 1.

The drive shaft 10 for winding a spring projects downwardly through the hole 1e at the bottom of the cylinder unit 1d; the projection of the drive shaft 10 is fitted with a winding knob 15.

The shaft of the middle gear 7 of the speed increasing gear train is dropped into the bearing grooves 1h, 1i of the bearing units 1f, 1g formed on frame 1 and rotatably supported therein; the shaft retainer units 2n, 2o of the housing unit 2 contact the bearing units 1f, 1g.

The shaft of the worm gear 8 is dropped into the bearing grooves 1h, 1i of the bearing units 1f, 1g formed on frame 1 and also into the bearing groove 1m of the bearing unit 1k formed on frame 1, and the shaft of the worm gear 8 is rotatably supported therein; the shaft retainer 2p contacts the bearing groove 1j of the bearing unit 1f.

The lower end tenon 5a of the worm shaft 5, as illustrated in FIG. 3, is rotatably supported by the bowl-shaped bearing hole 1o with an opening at its upper end of the bearing unit 1n cylindrically formed on frame 1; the upper end tenon 5b of the worm shaft 5 is rotatably supported by the shaft retaining hole 2m of the bearing unit 2i.

The notch 1p which is a part of the bearing unit 1n is communicated with a part of the gear 8a of the worm gear 8 and mated with the worm unit 5d.

Next, the music box operation is described. First, the winding knob 15 is rotated and a spring that is retained in the spring enclosure 2d is wound. As the spring is gradually released under control of the speed governor S, the drum 3 is rotated and the pins 3a play the vibrating reeds 4a of the vibrating plate 4. This is how the music box plays.

When drum 3 is rotated, the worm shaft 5 is accelerated integrally with the rotor 6 via the flat gear 11, middle gear 7 of the speed increasing gear train, and the worm gear 8.

As the rotational speed of rotor 6 increases, a pair of weight units 6b, 6b supported by the connecting units 6c, 6c are spread in the axial and radial directions of the worm shaft; the contact units 6d, 6d contact the brake unit 2k; as the result of the contact frictional force, rotor 6 is decelerated. On the other hand, as the rotational speed of rotor 6 is decreased, the pair of weight units 6b, 6b are spread in the axial and radial directions of the worm shaft 5; the contact units 6d, 6d leave the brake unit 2k; thus the brake is released. In other words, the sequential operation affects speed regulation, thus governing the rotational speed of drum 3.

The above mentioned embodiment related to a music box with a speed governor using an elastic material such as rubber. However, this invention is not limited to this embodiment. As long as a music box has a housing unit comprised of a support unit integral with a spring enclosure, this invention can be used for any music box with other kinds of speed governing means such as an air governor and the like made of resins, metals, and the like.

With the above mentioned configuration of a housing unit 2, when an extremely large load is applied, in terms of dropping, pulling, and the like, to a support unit 2D which has a bearing unit 2i supporting a worm shaft 5, the bearing unit 2i is attached to an elastic arm 2h while at the same time, the bearing unit 2i is separated from the outer frame 2g by slit 2j which surrounds both sides of the arm 2h and most of the circumference of the bearing unit 2i. Therefore, the structure does not transmit the excessive load directly to the bearing unit 2i. In addition, the arm 2h deforms to absorb external force, thus preventing the end tenon 5b of the worm shaft 5 from scratching the shaft hole 2m and preventing the music box from having a driving problem.

In the axial direction of the worm shaft 5 of the outer frame 2g, the height of the surface opposite of the worm shaft 5 is formed higher than that of the surface of the bearing unit 2i. This does not transmit the excessive load directly to the above mentioned surface of the bearing unit 2i even if the music box is dropped or smashed and the like. As a result, the bearing unit 2i is protected.

In addition, the outer frame is formed thick to increase its rigidity; it can absorb excessive load.

On a spring enclosure 2d side of the thick outer frame 2g are formed two grooves 2r, thus preventing loosening or deformation when the housing unit 2 is integrally formed using resin and the like.

Because the housing unit 2 is formed using resin, molding a complex geometry is possible while maintaining resiliency.

Furthermore, there is no pillar between the support unit 2D and frame 1, so there is no limit on the spacing of a stopper which stops the music box playing. As a result, when installing a music box on a product, a broader range of choice among locations, directions, and arrangements is provided.

While the foregoing description and drawings represent the preferred embodiments of the present invention, it will be obvious to those skilled in the art that various changes and modifications may be made therein without departing from the true spirit and scope of the present invention.

What is claimed is:

1. A music box comprising:

a drive shaft for winding a spring;

a drum which rotates with transmitted rotation of said drive shaft when a spring is released;

a vibrating plate with reeds for playing music when struck by pins on said drum;

speed governing means having a speed increasing gear train which transmits the rotation of said drive shaft and a worm shaft which is positioned in a final step of said speed increasing gear train and on which a rotor is fixed;

a frame for rotatably supporting said drive shaft and one end of said worm shaft, and on which said drum, said vibrating plate and said speed governing means are arranged;

a housing unit which rotatably supports said drive shaft and has a spring enclosure for enclosing the spring and a support unit which is formed at an end of said spring enclosure and supports the other end of said worm shaft;

said support unit comprising:

a bearing unit which rotatably supports the other end of said worm shaft at a center thereof;

an outer frame formed to enclose said bearing unit; and a slit being formed between said bearing unit and said outer frame.

2. A music box according to claim 1 wherein fitting members are formed on said frame in said housing unit to fit said frame.

3. A music box according to claim 1 wherein said housing unit is formed of synthetic resin.

4. A music box according to claim 3 wherein said bearing unit is connected to an elastic arm.

5. A music box according to claim 4 wherein said slit is formed circularly central to said worm shaft and said arm is positioned on a side of said spring enclosure.

6. A music box according to claim 3 wherein the thickness of said outer frame is formed thicker than that of said bearing unit.

7. A music box according to claim 6 wherein a concavity is formed on said spring enclosure side on said outer frame.

8. A music box according to claim 3 wherein the height of the surface opposite of said worm shaft of said outer frame is formed higher than that of the surface opposite of the bearing of said worm shaft of said bearing unit.

9. A music box according to claim 8 wherein the thickness of said outer frame is formed thicker than that of said bearing unit.

10. A music box according to claim 9 wherein a concavity is formed on said spring enclosure side on said outer frame.

11. A music box according to claim 1 wherein a brake unit is formed on said worm shaft side surface on said outer frame.

12. A music box according to claim 11 wherein said brake unit is formed in a ring shape and arranged circularly central to said worm shaft.

13. A music box according to claim 3 wherein a brake unit is formed on said worm shaft side surface on said outer frame.

14. A music box according to claim 13 wherein said brake unit is formed in ring-shape and circularly central to said worm shaft.

15. In a music box having a drive shaft, a drum, a vibrating plate, speed governing means, a frame and a housing unit, wherein said speed governing means includes a speed increasing gear train to which a worm shaft is coupled and wherein said frame rotatably supports said drive shaft and one end of the worm shaft, the improvement comprising that:

said housing unit rotatably supporting said drive shaft and has a spring enclosure for enclosing a spring and a support unit formed at an end of said spring enclosure for supporting the other end of the worm shaft, said support unit comprising:

a bearing unit which rotatably supports the other end of the worm at a center thereof; and an outer frame formed to enclose said bearing unit;

said bearing unit being spaced apart from said outer frame.

* * * * *